United States Patent [19]

Yoshinari et al.

[11] Patent Number: 4,659,623

[45] Date of Patent: Apr. 21, 1987

[54] ACRYLIC FIBERS FOR PRODUCING PREOXIDIZED FIBERS

[75] Inventors: Osamu Yoshinari; Yoshifumi Kawakatsu; Hayashi Takahashi; Hideaki Fukuizumi, all of Shizuoka, Japan

[73] Assignee: Toho Beslon Co., Ltd., Tokyo, Japan

[21] Appl. No.: 610,080

[22] Filed: May 14, 1984

[30] Foreign Application Priority Data

May 14, 1983 [JP] Japan ..... 58-83483

[51] Int. Cl.[4] ..... D02G 3/00

[52] U.S. Cl. ..... 428/395; 428/364; 428/375; 428/367

[58] Field of Search ..... 428/375, 379, 373, 374, 428/421, 422, 395, 364, 367; 524/140, 145, 565

[56] References Cited

U.S. PATENT DOCUMENTS

| | | | |
|---|---|---|---|
| 3,232,790 | 1/1966 | Enders | 428/394 |
| 3,459,722 | 8/1969 | Zanger | 428/375 |
| 3,824,126 | 7/1974 | Katsushima et al. | 524/140 |
| 4,093,775 | 6/1978 | Szur | 428/394 |
| 4,098,741 | 7/1978 | Login | 428/395 |

*Primary Examiner*—Lorraine T. Kendell

*Attorney, Agent, or Firm*—Sughrue, Mion, Zinn, Macpeak, and Seas

[57] ABSTRACT

Acrylic fibers suitable for producing preoxidized fibers free from coalescence which have a fluorine-containing surface active agent or further have at least one phosphoric surface active agent selected from the group consisting of compounds represented by the following formulae (I), (II) and (III):

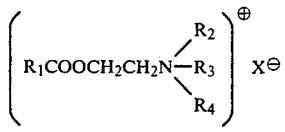

(I)

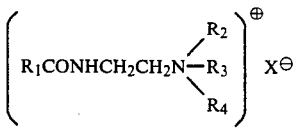

(II)

$$[R_1CON(CH_2CH_2OH)_2]X' \quad \text{(III)}$$

(wherein all the symbols are defined in the appended claims).

10 Claims, No Drawings

ACRYLIC FIBERS FOR PRODUCING PREOXIDIZED FIBERS

FIELD OF THE INVENTION

The present invention relates to acrylic fibers suitable for producing preoxidized (flame-resistant) fibers at high temperatures. The present invention also relates to processes for producing such acrylic fibers, preoxidized fibers from such acrylic fibers and carbon fibers having high qualities and high strength from such preoxidized fibers.

BACKGROUND OF THE INVENTION

It has heretofore, been known to obtain carbon fibers by subjecting acrylic fibers to preoxidation in an oxidizing atmosphere (containing oxygen) at 200° to 300° C., preferably under tension, and then subjecting the resulting preoxidized fibers to carbonization in an inert gaseous atmosphere at 500° C. or higher, preferably under tension (these methods are described in, for example, U.S. Pat. No. 4,069,297).

In these manufacturing processes, the preoxidation is an oxidation reaction. At high temperature the preoxidation can be carried out in a short period of time and is economical. However, when the preoxidation is carried out at high temperature heat is locally built up in the fibers and causes coalescence of the preoxidized fibers to one another. Carbon fibers having high qualities and high strength cannot be obtained from such preoxidized fibers.

In order to preventing coalescence, it has been proposed, for example, to adhere a cationic surface-active agent to the starting acrylic fibers (such is described in Japanese Patent Publication (unexamined) 112410/1982). To conduct preoxidation in a short period of time, it is required to effect the treatment at a higher temperature. With the above proposed technique, it is difficult to prevent coalescence of the preoxidized fibers during preoxidation at high temperature.

SUMMARY OF THE INVENTION

One object of the present invention is to provide acrylic fibers from which preoxidized fibers can be produced without coalescence even when preoxidation is carried out at high temperature, and a process for producing such acrylic fibers.

It is another object of the present invention to provide preoxidized fibers which undergo substantially no fiber coalescence and a process for producing such preoxidized fibers.

It is still another object of the present invention to provide preoxidized fibers suitable for producing high strength carbon fibers and a process for producing such carbon fibers.

Per the present invention acrylic fibers for the production of preoxidized fibers or carbon fibers, have a fluorine-containing surface active agent applied thereto.

The present invention also includes acrylic fibers highly suitable for the production of preoxidized fibers or carbon fibers, which arcylic fibers having a fluorine-containing surface active agent and at least one phosphoric surface active agent represented by the following formulae (I), (II) and (III):

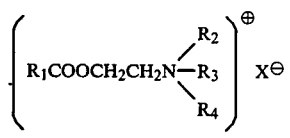

(I)

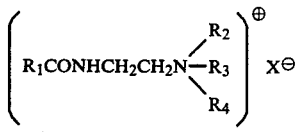

(II)

$$[R_1CON(CH_2CH_2OH)_2]X' \quad \text{(III)}$$

wherein $R^1$ represents an aliphatic hydrocarbon group having 11 to 17 carbon atoms, $R_2$, $R_3$ and $R_4$ may be the same or different and each represents a hydrogen atom, a lower alkyl group preferably having 1–3 carbon atoms, a hydroxyethyl group or a hydroxyisopropyl group,

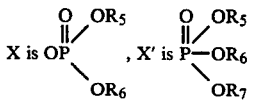

herein $R_5$, $R_6$ and $R_7$ may be the same or different and each represents a hydrogen atom or a hydroxyethyl group.

When the acrylic fibers of this invention having a fluorine-containing surface active agent applied thereto are subjected to a preoxidation treatment at high temperatures, preoxidized fibers free from coalescence are obtained, and consequently carbon fibers free from coalerscence can be obtained therefrom. The carbon fibers thus obtained have high qualities and high strength.

When the acrylic fibers of this invention having a fluorine-containing surface active agent and at least one of surface active agents of formulae (I), (II) and (III) applied thereto are used, fiber coalescence does not occur in the preoxidation treatment at high temperatures. In addition, suitable bundlability is imparted to the fiber bundle so that the occurrence of fluffs or the wrapping of the fibers around the guide roller can be prevented. This in turn leads to a reduction in the occurrence of fluffs or the wrapping of the fibers around the guide roller during carbonization.

The acrylic fibers used in this invention are obtained from a polymer preferably composed of at least 95 mole % of acrylonitrile and not more than 5 mole % of a vinyl monomer copolymerizable with acrylonitrile.

The vinyl monomer or comonomer component may be any known unsaturated vinyl compound copolymerizable with acrylonitrile. Examples include methyl acrylate, ethyl acrylate, methyl methacrylate, acrylamide, N-methylol acrylamide, vinyl acetate, acrylic acid, methacrylic acid, itaconic acid, sodium allylsulfonate, sodium methallylsulfonate, and salts thereof.

The acrylonitrile fibers are produced by polymerizing at least 95 mole % of acrylonitrile and not more than 5 mole % of a vinyl monomer copolymerizable with acrylonitrile in a known solvent for polyacrylonitrile (dimethylformamide, a concentrated aqueous solution of zinc chloride, dimethyl sulfoxide, dimethylacetamide) using a known catalyst (benzolyl peroxide, hydrogen peroxide, sodium persulfate, thereafter forcing the solution of the resulting acrylonitrile polymer or copolymer having a molecular weight of 40,000 to 200,000 under pressure through orifices into a dilute solvent solution, removing the solvent from the resulting filaments to obtain gel fibers, and then drying, stretching and relaxing the filaments. The resulting fibers usually consists of a bundle of 500 to 100,000 monofilamants having a size of 0.1 to 3.0 denier. In the production of acrylonitrile fibers, generally, treatments such as stretching, drying and relaxing are carried out after spinning and solvent removal.

The fluorine - containing surface active agent which is used in this invention are commercially available. Examples are shown below.

Nonionic surface active agent (1) Oligomers having a perfluoroalkyl group having preferably 5–8 carbon atoms, a hydrophilic group such as polyoxyethylene group derived from ethylene oxide, and oleophilic groups such as polyoxypropylene group derived from propylene oxide. Examples of this agent include oligomers obtained by polymerization of (i) a compound represented by the following general formula $C_8F_{17}SO_2N\ R_2CH_2CH_2OOCCH{=}CH_2$, (wherein $R_2$ represents an alkyl group having 1–3 carbon atoms) (II) an acrylic monomer of polyoxyethylene containing 10–50 of oxyethylene units, and (iii) an acrylic monomer of polyoxypropylene containing 10–50 of oxypropylene units. A specific example of such oligomer includes F-177 which is an oligomer having a molecular weight of 2,500 to 10,000 and $R_2$ is $C_3H_7$ group.

(2) Oligomers having a perfluoroalkyl group and hydrophilic group, wherein both groups are the same as disclosed in (1), respectively. A specific example of such oligomer includes F-171 which is an oligomer having a molecular weight of 2,500 to 10,000 and $R_2$ is $C_3H_7$ group. (Molecular weight of a polymer in this invention is obtained in accordance with Staudinger's equation.)

(3) Perfluoroalkylsulfamoylethylene oxide adducts having the formula $R_1SO_2NR_2(C_2H_4O)_nH$ (wherein $R_1$ is a perfluoroalkyl group having preferably 5 to 8 carbon atoms, $R_2$ is an alkyl group having 1–3 carbon atoms and n is preferably 10 to 20)

Example: F-142D: $R_1=C_8F_{17}$, $R_2=C_3H_7$, n=10

Example: F-144D: $R_1=C_8F_{17}$, $R_2=C_3H_7$, n=20

Anionic surface active agent (1) Perfluoroalkylsulfonic acid salts having the formula $R_1SO_3M$ (the definition for $R_1$ is the same as disclosed hereinabove and M is Na or K)

Example: F-110: $C_8F_{17}SO_3K$

Example: F-113: $C_5F_{11}\sim C_8F_{17}SO_3K$ (mixture)

(2) Perfluoroalkylsulfamoylcarboxylic acid salts having the formula $R_1SO_2NR_2CH_2COOM$ (wherein definitions for $R_1$, $R_2$ and M are the same as disclosed hereinabove)

Example: F-120: $R_1=C_8F_{17}$, $R_2=C_3H_7$, M=K (3) Perfluoroalkylsulfamoylphosphate of the formula $$R_1SO_2NR_2CH_2CH_2O-\overset{\overset{\displaystyle O}{\|}}{P}-(OH)_2$$

(wherein definitions for $R_1$ and $R_2$ are the same as disclosed hereinabove)

Example: F-191: $R_1=C_8F_{17}$, $R_2=C_3H_7$

Cationic surfactants (1) Perfluoroalkylsulfamoyl trimethyl ammonium salts of the formula;

$$[R_1SO_2NHCH_2CH_2CH_2N(CH_3)_3]^{\oplus}X^{\ominus}$$

(wherein the definition for $R_1$ is the same as disclosed hereinabove and X is Cl, I or $CH_3COO$)

Example: F-150: $R_1=C_8F_{17}$, X=I

The above designations, such as F-177, are designations of Dai-Nippon Ink and Chemicals, Inc., the manufacturer.

Furtheremore, in the present invention the fluorine-containing surface-active agent can be applied to the fibers as a mixture with a surface-active agent represented by formula (1), (2) or (3) earlier given.

In formulae (1), (2) and (3) $R_1$ represents an aliphatic hydrocarbon group having 11 to 17 carbon atoms, particularly a straight-chain saturated aliphatic hydrocarbon group; $R_2$ to $R_4$ each represent a hydrogen atom, a lower alkyl group preferably having 1 to 3 carbon atoms, such as a methyl or ethyl group, a hydroxyethyl group, or a hydroxyisopropyl group; and X represents a phosphoric acid ion or a phosphoryl mono-(di-, or tri-) hydroxyethyl ion as earlier defined.

The compounds represented by formulae (1), (2) and (3) may be used singly or as a mixture of two or more thereof.

Examples of the compounds of formula (1) are shown below.

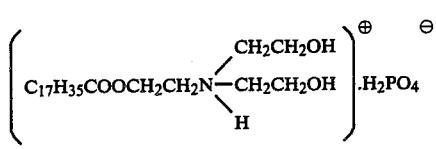

(I)-(1)

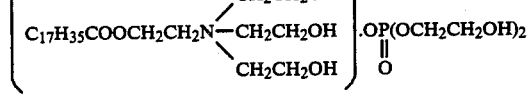

(I)-(2)

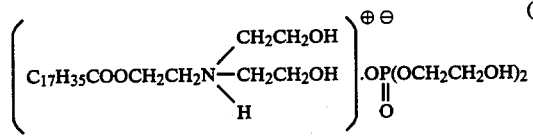

(I)-(3)

An example of the compounds of formula (II) is as follows:

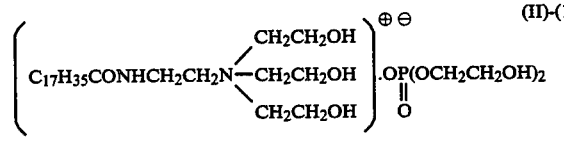

(II)-(1)

-continued

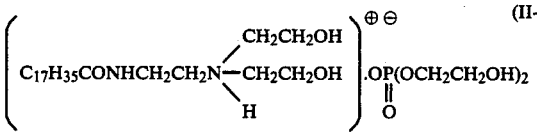

(II-(2)

An example of the compounds of formula (III) is as follows:

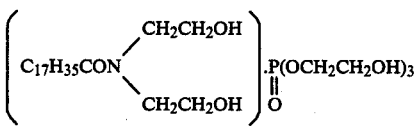

(III)-1

The surface active agent (or agents) used in the present invention is applied to the acrylic fiber during or after production thereof when the acrylic fibers are produced by wet spinning. The surface active agent is preferably applied to the acrylic fiber after removal of the solvent used for spinning. It is more preferable to apply before drying the gel fibers obtained after removal of the solvent. Stretching may be conducted during the production of the acrylic fiber of the present invention in a conventional manner.

To apply the surface active agent to the fibers, an aqueous solution or dispersion of the surface active agent can be used.

The phosphoric surface active agent may be applied to the fibers after, or before applying the fluorine-containing surface active agent(s), preferably before, or the phosphoric surface active agent may be incorporated in the solution or dispersion of the fluorine-containing surface active agent. When treatments with the surface active agents are conducted separately from each other, it is preferable to conduct drying, usually at about up to 150° C. after the first treatment. As a solvent or medium for forming a solution or a dispersion, water or an organic solvent such as methanol, ethanol, isopropyl alcohl, aceton or mixture thereof may be used.

The applying is generally conducted by immersing an acrylic fiber bundle into the solution or dispersion or by spraying the solution or dispersion onto the bundle. It is not necessary to use a solution or dispersion containing the surface active agent or agents at high temperature. The temperature is usually 10° to 60° C., and preferably not higher than 50° C.

The concentration of the fluorine-containing surface active agent, the phosphoric surface active agent, or the mixture thereof is preferably 1.0 to 15 g/liter and more preferably 3 to 6 g/liter. The amount of a surface active agent to be applied can be adjusted by varying the concentration of the surface active agent.

When acrylic fivers are produced by melt spinning the surface active agent (or agents) may be applied to the fibers at any time by, for example, incorporating it to an acrylic polymer to be subjected to melt spinning. Alternatively, the surface active agent (or agents) may be applied to the fiber after production of the acrylic fibers. When both of the fluorine-containing surface active agent and the phosphoric surface active agent are used to prepare the acrylic fibers of the present invention, only one of them may be incorporated to the acrylic polymer before spinning and the other agent may be applied after spinning of the acrylic fibers.

When a solution or dispersion of the surface active agent (or agents) is used for application of the surface active agent, generally, drying is conducted after the application. The drying is preferably conducted at a temperative of up to 150° C.

The surface active agent (or agents) thus supplied to acrylic fibers adhered on the surface of the fiber, impregnates to the fiber and/or is present uniformly through the fiber depending on the method for applying the surface active agent to the acrylic fiber.

When the phosphoric surface active agent is used singly for a long period of time, an oil scum is undesirably formed in the solution or dispersion thereof. However, when the phosphoric surface active agent is used with the fluorine-containing surface active agent this increases the dispersability of the system and is effective to prevent the formation of the oil scum.

The proportion of the phosphoric surface active agent applied to the fibers is 0–95% by weight of the total amount of the surface active agents applied to the fibers. The preferred proportion is 30 to 90% by weight. Addition of more than 95% by weight of the phosphoric surface active agent is not effective to prevent coalescence of preoxidized fibers and does not yield carbon fibers having high strength.

When the phosphoric surface active agent is not used, the bundlability (gathering property for maintaining fibers in one bundle) of the acrylic fibers is somewhat reduced but the resulting carbon fibers have high strength. The amount of the fluorine-containing surface active agent or the total amount of the fluorine-containing surface active agent and the phosphoric surface active agent applied to the acrylic fibers is 0.01 to 0.5% by weight based on the treated acrylic fibers. If it is less than 0.01%, it is difficult to sufficiently obtain the effect of the present invention. Application of a great amount of the surface active agent or surface active agents beyond 0.5% tends to reduce the effect. The preferred amount is 0.03 to 0.1%.

Acrylic fibers were used as a starting material and subjected to preoxidation in air under varying conditions. The state of coalescence of the preoxidized fibers was observed and is shown in Table 1.

TABLE 1

| Preoxidation Conditions | Surface Active Agent: Invention: F-177 | Surface Active Agent: Invention: (11)-(1) + F-177 (50%) + (50%) | Surface Active Agent: Comparison (11)-(1) |
|---|---|---|---|
| 260° C., 1.5 hr | no | no | no |
| 255° C., 40 min | no | no | no |
| 280° C., 20 min | | | |
| 270° C., 40 min | no | no | 30–40 |
| 265° C., 20 min | no | no | 40–50 |
| 280° C., 10 min | | | |

Note: Method of measuring coalescence:

Preoxidized fiber strands or carbon fiber strands were cut to a length of 3 mm, put in acetone and subjected to ultrasonic washing. The surface active agent was removed by dissolution and the number of thick coalesced filaments was counted under a microscope at a magnification of 6.3.

Even when the preoxidation was conducted at high temperature as in Table 1, no coalescence was observed with preoxidized fibers per the present invention.

The preoxidation of the acrylic fibers of this invention having the surface active agent applied thereto can be carried out by using any conventional preoxidation conditions for acrylic fibers.

Since no coalescence occurs even when the preoxidation is carried out at high temperature, the preoxidation can be carried out effectively within a short period of time. Preferably, the preoxidation treatment is carried out in air at 250° to 350° C., especially 260° to 290° C., for 0.1 to 1 hour under a tension of 10 to 100 mg/d until the specific gravity of the fibers becomes 1.40 to 1.45.

Carbonization of the thus obtained preoxidized fibers is carried out using conventional carbonization conditions, that is, it is generally carried out in an inert gas atmosphere such as nitrogen, argon or helium at 1000° to 1500° C. under a tension of 10 to 100 mg/d. As a result, carbon fibers having a tenacity of more than 450 kg/mm$^2$ can be obtained in a stable manner.

Examples of this invention are shown below together with a Comparative Example. Number of fluffs in Examples were counted as shown below;

A 12,000 filament strand is dipped in acetone to remove the surface active agent. The strand is stretched over a span of about 1.3 meters, and acetone is removed by air drying. Then air is blown to open the strand. The number of fluffs on a length of 1 meter is counted. Unless otherwise indicated herein, all parts, percents, ratio and the like are by weight.

Number of fluffs in Examples were counted as shown below;

A 12,000 filament strand is dipped in acetone to remove the surface active agent. The strand is stretched over a span of about 1.3 meters, and acetone is removed by air drying. Then air is blown to open the strand. The number of fluffs on a length of 1 meter is counted.

Stretching is controlled by varying the speed of rollers which transfer fibers, and the degree of stretching is shown by the ratio of the linear speed of the roller to the speed of fibers at spinning.

Unless otherwise indicated herein, all parts, percents, ratios and the like are by weight.

EXAMPLE 1

100 parts of a mixture of 98 mole % of acrylonitrile, 0.5 mole % of acrylic acid, 1.5 mole % of methyl acrylate and 1 part of sodium persulfate was dissolved in 1000 parts of a 60% aqueous solution of zinc chloride, and polymerized at 55° C. for 4 hours to obatin a solution of an acrylic polymer having a molecular weight of 55,000 and a viscosity of 98 poises (obtained in accordance with Staudinger's equation). The polymer solution was forced into a 25% aqueous solution of zinc chloride through a nozzle with 12,000 orifices and a diameter of 0.05 mm, and then, while washing the filaments with water to remove zinc chloride from them, the filaments were drawn to 3 times. Separately, an aqueous solution of an oligomer of F-177 in a concentration of 5 g/liter was prepared. The fibers drawn to 3 times were dipped in this aqueous solution for 0.2 minute, dried at 120° C., and then continuously drawn to 4.5 times in saturated steam at 125° C. to give acrylic fibers having a monofilament denier of 0.9, a tenacity of 8 g/d and an elongation of 7.5%. Ten grams of the resulting fibers were extracted with a mixture of equal amounts of ethanol and benzene by means of a Soxhlet extractor, and the amount of the surface active agent adehered and inpregnated to the fibers was measured. It was 0.06%. The acrylic fibers (12,000 filaments) so obtained were subjected to preoxidation in air at 270° C. under a tension of 30 mg/d for 40 minutes. The resulting preoxidized fibers had a specific gravity of 1.40, and no coalescence among the monfilaments was observed under a microscope at a magnificiation of 6.3. The preoxidized fibers were carbonized in a stream of nitrogen at 1400° C. under a tention of 30 mg/d for 1 minute to give carbon fibers of high tenacity having a tensile strength of 490 kg/mm$^2$ and a tensile modulus of 24,500 kg/mm$^2$.

No coalescence among the monofilaments was observed in the resulting carbon fibers. Number of fluffs was 93/m.

EXAMPLE 2

Fibers drawn to 3 times, which had been obtained under the same operating conditions as in Example 1, were treated with an aqueous solution or an isopropyl alcohol/water mixed solution (a 23% aqueous solution of isopropyl alcohol) of each of the fluorine-containing surface active agent shown in Table 2 at a concentration of 5 g/liter under the same operating conditions as in Example 1.

The acrylic fibers shown in the Table 2 were obtained.

TABLE 2

| Type of the fluorine-containing surface-active agent | Solvent | Properties of Acrylic Fibers |
|---|---|---|
| Anionic F-191 | 23% isopropyl alcohol aqueous solution | Monofilament denier 0.9<br>Tenacity 7.8 g/d<br>Elongation 8.1% |
| Cationic F-150 | Water | Monofilament denier 0.9<br>Tenacity 7.3 g/d<br>Elongation 8.2% |

The amount of each of the surface active agents applied to the acrylic fibers was measured in the same way as in Example 1 using 10 g of fiber sample. It was found that the amount of the anionic surface active agent was 0.05%, and the amount of the cationic surface active agent was 0.06%. The resulting acrylic fibers (12,000 filaments) were subjected to preoxidation in air at 270° C. under a tention of 30 mg/d for 40 minites. The resulting fibers had a specific gravity of 1.40 and no coalescence among the monofilaments was observed under a microscope at a magnification of 6.3.

The flame-resistant fibers were carbonized in a stream of nitrogen at 1400° C. under a tension of 30 mg/d for 1 minute. Carbon fibers having the properties shown in Table 3 were obtained.

TABLE 3

| Type of the fluorine-containing surface-active agent | Properties of the carbon fibers |
|---|---|
| Anionic F-191 | Tensile strength 480 kg/mm$^2$<br>Tensile modulus 24,400 kg/mm$^2$<br>Number of fluffs 90/m |
| Cationic F-150 | Tensile strength 485 kg/mm$^2$<br>Tensile modulus 24,400 kg/mm$^2$<br>Number of fluffs 92/m |

No coalescence among monofilaments was observed with either of these carbon fibers.

EXAMPLE 3

Fibers drawn to 3 times, which were obtained at the same operating conditions as in Example 1, were treated with a 5 g/liter aqueous solution of 70% of compound (III)-(1) and 30% of a phosphoric surface active agent, F-177 under the same operating conditions as in Example 1 to obtain acrylic fibers having a monofilament denier of 0.9, a tenacity of 7.8 g/d and an elongation of 8%. The amount of the mixed surface active agents applied to the acrylic fibers, measured by using a 10 g fiber sample in the same way as in Example 1, was 0.07%.

The acrylic fibers so obtained (12,000 filaments) were subjected to preoxidation in air at 270° C. under a tension of 30 mg/d for 40 minutes. The resulting preoxidized fibers had a specific gravity of 1.40, and no coalescence among the monofilaments was observed under a microscope at a magnification of 6.3. The preoxidized fibers were carbonized in a stream of nitrogen at 1400° C. under a tension of 30 mg/d for 1 minute to obtain carbon fibers of high strength having a tensile strength of 460 kg/mm$^2$ and a tensile modulus of 24,300 kg/mm$^2$. No coalescence among the monofilaments was observed in the resulting carbon fibers. Number of fluffs was 60/m.

EXAMPLE 4

Fibers drwan to 3 times, which were obtained at the same operating conditions as in Example 1, were treated with a 5 g/liter aqueous solution of a mixture of 50% of F-142D and 50% of the phosphoric surface active agent of formula (II)-(2) under the same operating conditions as in Example 1 to obtain acrylic fibers having a monofilament denier of 0.9, a tenacity of 7.6 g and an elongation of 7.5%. The amount of the mixed surface active agents adhered to the acrylic fibers, measured by using a 10 g fiber sample in the same way as in Example 1, was 0.06%.

The resulting acrylic fibers (12,000 filaments) were subjected to preoxidation in air at 270° C. under a tension of 30 mg/d for 40 minutes. The resulting fibers had a specific gravity of 1.40 and no coalescence among the monofilaments was observed under a microscope at a magnification of 6.3. The preoxidized fibers were carbonized in a stream of nitrogen at 1400° C. under a tension of 30 mg/d for 1 minute to obtain high-strength carbon fibers having a tensile strength of 470 kg/mm$^2$ and a tensile modulus of 24,300 kg/mm$^2$. No coalescence among the monofilaments was observed in these carbon fibers. Number of fluffs was 65/m.

EXAMPLE 5

Using the Example 4 fibers drawn to 3 times they were treated with a 5 g/liter aqueous solution of a mixture of 97% of the phosphoric surface active agent of formula (II)-2 and 3% of the fluorine-containing surface active agent, F-142D under the same operating conditions as in Example 1 to obtain acrylic fibers having a monofilament denier of 0.9, tenacity of 7.5 g/d and an elongation of 7.5%. The amount of the mixed surface active agent applied to the acrylic fibers, measured using a 10 g fiber sample in the same way as in Example 1, was 0.05%.

The resulting acrylic fibers (12,000 filaments) were subjected to preoxidation in air at 270° C. under a tension of 30 mg/d for 40 minutes. The resulting preoxidized fibers had a specific gravity of 1.40, and coalescence among the monofilaments was scarcely observed under a microscope at a magnification of 6.3. The preoxidized fibers were carbonized in a stream of nitrogen at 1400° C. under a tension of 30 mg/d for 1 minute to obtain carbon fibers having a tensile strength of 430 kg/mm$^2$ and a tensile modulus of 24,200 kg/mm$^2$. Coalescence among the monofilaments was scarcely observed in these carbon fibers. Number of fluffs was 55/m.

EXAMPLE 6

Fibers drawn to 3 times, obtained under the same conditions as in Example 1, were treated with a 5 g/liter aqueous solution of a mixture of 60% phosphoric surface active agent of formula (I)-(3) and 40% of the fluorine-containing surface active agent, F-177 under the same operating conditions as in Example 1 to obtain acrylic fibers having a monofilament denier of 0.9, a tenacity of 7.6 g/d and an elongation of 7.5%. The amount of the mixed surface active agents applied to the acrylic fibers, measured using a 10 g fiber sample in the same way as in Example 1, was 0.06%.

The resulting acrylic fibers (12,000 filaments) were subjected to preoxidation in air at 270° C. under a tention of 30 mg/d for 40 minutes. The resulting fibers had a specific gravity of 1.40, and no coalescence among the monofilaments was observed under a microscope at a magnification of 6.3.

The preoxidized fibers were carbonized in a stream of nitrogen at 1400° C. under a tension of 30 mg/d to obtain carbon fibers having a tensile strength of 470 kg/mm$^2$ and a tensile modulus of 24,400 kg/mm$^2$. No coalescence among the monofilaments was observed in the carbon fibers. Number of fluffs was 63/m.

EXAMPLE 7

Fibers drawn to 3 times, obtained under the same operating conditions as in Example 1, were treated with a 5 g/liter aqueous solution of a mixture of 95% of the phosphoric surface active agent of formula (III)-(1) and 5% of the fluorine-containing surface active agent F-191:

$$C_8F_{17}SO_2\underset{\underset{C_3H_7}{|}}{N}CH_2CH_2O-\overset{\overset{O}{\|}}{P}(OH)_2$$

in the same way as in Example 1 to obtain acrylic fibers having a monofilament denier of 0.9, a tenacity of 7.5 g and an elongation of 7.7%. The amount of the mixed surface active agents applied to the acrylic fibers, measured using a 10 g fiber sample in the same way as in Example 1, was 0.06%.

The resulting acrylic fibers (12,000 filaments) were subjected to preoxidizing in air at 270° C. under a tension of 30 mg/d for 40 minutes. The resulting preoxidized fibers had a specific gravity of 1.40 and no coalescence among the monofilaments was observed under a microscope at a magnification of 6.3. The preoxidized fibers were carbonized in a stream of nitrogen at 1400° C. under a tension of 30 mg/d for 1 minute to obtain carbon fibers having a tensile strength of 480 kg/mm$^2$ and a tensile modulus of 24,400 kg/mm$^2$. No coalescence among the monofilaments was observed in these carbon fibers. Number of fluffs was 55/m.

COMPARATIVE EXAMPLE

Fibers drawn to 3 times, obtained under the same operating conditions as in Example 1, were treated with a 5 g/liter aqueous solution of 100% of phosphoric surface active agent (III)-(1) under the same operating conditions as in Example 1 to obtain acrylic fibers having a monofilament denier of 0.9, tenacity of 6.8 g/d and an elongation of 7.0%. The amount of the surface active agent applied 1 to the acrylic fibers, measured using a 10 g fiber sample in the same way as in Example 1, was 0.07%. The resulting acrylic fibers (12,000 filaments) were subjected to preoxidizing in air at 270° C. under a tension of 30 mg/d for 40 minutes. The resulting preoxidized fibers had a specific gravity of 1.40, and when they were observed under a microscope at a magnification of 6.3, coalescence among the monofilaments was noted. The preoxidized fibers were carbonized in a stream of nitrogen at 1400° C. under a tension of 30 mg/d for 1 minute to obtain carbon fibers having a tensile strength of 420 kg/mm$^2$ and a tensile modulus of 24,400 kg/mm$^2$. Thirty to forty coalesced portion in the carbon fibers, were observed. Number of fluffs was 54/m.

EXAMPLE 8

Fibers drawn to 3 times, obtained under the same operating conditions as in Example 1, were immersed for 0.2 minute in a 4.6 g/liter aqueous solution of phosphoric surface active agent (I)-(3) and dried at 120° C. to obtain a fiber bundle having 0.055% of the compound applied thereto. Then, the fiber bundle was immersed in a 0.4 g/liter aqueous solution of the fluorine-containing surface active agent represented by the following formula

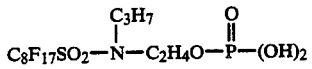

and dried to adhere 0.005% of this compound to the fiber bundle. It was then treated under the same operating conditions as in Example 1 to obtain acrylic fibers having a monofilament denier of 0.9, a tenacity of 7.6 g/d and an elongation of 7.5%.

These fibers were subjected to preoxidation and carbonization in the same way as in Example 1 to yield carbon fibers having a tensile strength of 470 kg/mm$^2$ and a tensile modulus of 24,300 kg/mm$^2$ which were free from coalescence among the monofilaments. Number of fluffs was 60/m.

EXAMPLE 9

Fibers drawn to 3 times, obtained under the same operating conditions as in Example 1, were treated in the same way as in Example 1 with a 5 g/liter aqueous solution of a mixture of 90% of the phosphoric surface active agent of formula (I)-(3) and 10% of the fluorine-containing surface active agent represented by the following formula

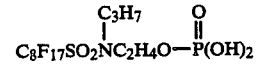

to give acrylic fibers having a monofilament denier of 0.9, a tenacity of 7.6 g/d and an elongation of 7.8%. The amount of the mixture of the above compounds adhered thereto was 0.05%.

These fibers were subjected to preoxidation and carbonization in the same way as in Example 1 to yield carbon fibers having a tensile strength of 475 kg/mm$^2$ and a tensile modulus of 24,300 kg/mm$^2$ which were free from coalescence. Number of fluffs was 57/m.

While the invention has been described in detail and with reference to specific embodiments tereof, it will be apparent to one skilled the art that various changes and modifications can be made therein without departing from the spirit and scope thereof.

What is claimed is:

1. Acrylic fibers for producing preoxidized fibers, said fibers having a fluorine-containing surface active agent applied thereto and at least one phosphoric surface active agent selected from the group consisting of compounds represented by the following formulae (I), (II) and (III) applied thereto:

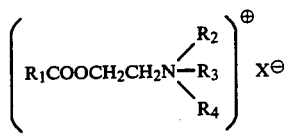

(I)

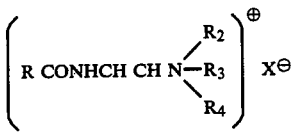

(II)

$$[R_1CON(CH_2CH_2OH)_2]X' \quad \text{(III)}$$

wherein $R_1$ represents an aliphatic hydrocarbon group having 1 to 17 carbon atoms, $R_2$, $R_3$ and $R_4$ which may be the same or different, each represents a hydrogen atom, a lower alkyl group, a hydroxyethyl group or a hydroxyispropyl group,

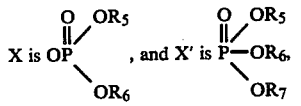

wherein $R_5$, $R_6$ and $R_7$, which may be the same or different, each represents a hydrogen atom or a hydroxyethyl group, wherein said acrylic fibers comprise a polymer obtained from at least 95 mole % acrylonitrole and not more than 5 mole % vinyl monomer copolymerizable with acrylonitrile.

2. Acrylic fibers as in claim 1, wherein said fluorine-containing surface active agent is a nonionic surface active agent.

3. Acrylic fibers as in claim 1, wherein said fluorine-containing surface active agent is a anionic surface active agent.

4. Acrylic fibers as in claim 1, wherein said fluorine-containing surface active agent is a cationic surface active agent.

5. Acrylic fibers as in claim 1, wherein said lower alkyl group has 1 to 3 carbon atoms.

6. Acrylic fibers as in claim 1, wherein the total amount of the fluorine-containing surface active agent and the phosphoric surface active agent is 0.01 to 0.5% by weight based on acrylic fibers, fluorine-containing surface active agent and phosphoric surface active agent.

7. Acrylic fibers as in claim 1, wherein the amount of the phosphoric surface active agent is up to 95% by weight based on the total amount of surface active agents.

8. Acrylic fibers as in claim 1, wherein the amount of the phosphoric surface active agent is 30 to 90% by weight based on the total amount of surface active agents.

9. Acrylic fibers as in claim 1, wherein the acrylic fibers are obtained from a copolymer obtained by polymerizing at least 95 mole % of acrylonitrile and not more than 5 mole % of a vinyl monomer copolymerizable with acrylonitrile in a solvent for polyacrylonitrile.

10. Acrylic fibers as in claim 1, wherein the total amount of the fluorine-containing surface active agent and the phosphoric surface active agent is up to 0.1% by weight based on the treated acrylic fiber.

* * * * *